US006193482B1

(12) United States Patent
Chen

(10) Patent No.: US 6,193,482 B1
(45) Date of Patent: Feb. 27, 2001

(54) STRUCTURE OF A PISTON OF AN AIR-FILING DEVICE

(76) Inventor: Chih-Ming Chen, PO Box 82-144, Taipei (TW)

( * ) Notice: Subject to any disclaimer, the term of this patent is extended or adjusted under 35 U.S.C. 154(b) by 0 days.

(21) Appl. No.: 09/422,962

(22) Filed: Oct. 22, 1999

(51) Int. Cl.[7] ..... F04B 39/10; F04B 53/12
(52) U.S. Cl. ..... 417/549; 415/545; 92/107
(58) Field of Search ..... 417/545–546, 417/548, 549, 552, 553, 557; 137/538; 92/107; 33/DIG. 17; 29/222

(56) References Cited

U.S. PATENT DOCUMENTS 5,191,863 * 3/1993 Hagiwara ..... 123/59 AC
5,380,175 * 1/1995 Amarume ..... 417/553
5,993,178 * 11/1999 Park et al. ..... 417/545
6,015,720 * 1/2000 Roth ..... 417/259

* cited by examiner

*Primary Examiner*—Teresa Walberg
*Assistant Examiner*—Thor Campbell
(74) *Attorney, Agent, or Firm*—A & J

(57) ABSTRACT

The present invention relates to an improved structure of a piston for air-filing device by making use of air pressure formed as a result of the reciprocation action of piston within the cylinder to urge an air-tightness disc mounted at the top of the piston to close rapidly and to open instantaneously. At the simultaneous reciprocation action of the piston, the cylinder is provided with a rapid flowing in of air without passing through an air-inlet valve and the air is compressible. This facilitates the speed of compression of the entry air, and avoids the installation of the air-inlet valve.

1 Claim, 5 Drawing Sheets

STRUCTURE OF A PISTON OF AN AIR-FILING DEVICE

BACKGROUND OF THE INVENTION a) Technical Field of the Invention

The present invention relates to an improved structure of a piston for air-filing device by making use of air pressure formed as a result of the reciprocation action of piston within the cylinder to urge an air-tightness disc mounted at the top of the piston to close rapidly and to open instantaneously.

b) Description of the Prior Art

FIG. 6 shows a conventional piston structure of an air-filing device, which employs high temperature resistant, and wear-resistant TEFLON (trademark of a plastic that stops things from sticking to it) material as piston cylinder ring. As the TEFLON material is highly flexible, it can be easily mounted to the piston. Thus, in conventional piston, circular shape TEFLON is directly mounted at the external surface of the piston to use as a cylinder ring for air-tightness.

As shown in the conventional cylinder piston apparatus A1, after the TEFLON material wears out, minute gaps may form between the cylinder wall A3 with the piston. Thus, air tightness cannot be obtained. If air leakage or the insufficient pressure is found in the air filing device, the entire air-filing device is damaged. This is one of the drawback of the conventional piston apparatus.

Furthermore, when the piston reciprocates within the cylinder, it is necessary to have an air-inlet valve apparatus A4, facilitating the entry of air, and then the air is compressed, and is formed into air pressure to be released. Other than the air leakage and insufficient air pressure as a result of wears of the TEFLON, the air inlet valve apparatus is also another drawback needed to be overcome. It is often that the air inlet valve body A41 is deformed, worn out, or spring A42 fatigue which cause a malfunction of opening or closing of the valve body. In particular, when an object enters and blocks the air inlet valve apparatus, the flowing of air is not smooth or the flowing-in air is insufficient. Thus, the drawbacks of the conventional air-filing device mentioned above have to be overcome.

SUMMARY OF THE INVENTION

Accordingly, it is an object of the present invention to provide an improved structure of a piston of an air-filing device, wherein the present apparatus not only solve the problem caused by the piston cylinder ring but also solve the problem caused by the air inlet valve apparatus.

Yet another object of the present invention is to provide an improved structure of a piston of an air-filing device, wherein no air inlet valve apparatus is required to achieve smooth air entry and to attain the required operation stroke for the piston.

It is another object of the present invention to provide an improved structure of a piston of an air-filing device, wherein the air entry, compression, and air discharging can be completed at the same time.

One aspect of the present invention is to provide an improved structure of a piston of an air-filing device comprising a pressure engaging ring, a top cylinder ring, an air-tightness disc, an air-tightness ring, a piston head body, a piston pin, a resilient ring, a positioning member, a bottom cylinder ring, and a linking rod, characterized in that the pressure engaging ring is used to secure the top cylinder ring onto the external edge of a protruded section located at the top of the piston head body; the top cylinder ring is made from TEFLON material and has a bottom lip edge section at the interior diameter thereof and is extended from the lower section of the exterior diameter thereof to form an inclined surface, the air tightness disc has a flat circular shape and has a center hole, and is used to pull and control the positioning member, the air-tightness disc is located at the protruded surface at the top of the piston head body so as to press and seal the air tightness ring, and close and seal at the air hole located at the protruded surface of the piston head body; the air-tightness ring is made from a rubber material and is retained at a recess provided at the top protruded surface of the piston head body to assure air-tightness capability at the circumference of the bottom edge of the air-tightness ring; the piston head body is provided with the top protruded section, and a recess is formed at the top surface of the protruded section, a plurality of air holes and center hole are provided within the recess; a bottom recess is provided below the piston head body; a resilient member having elasticity is mounted to the positioning member which is functioned together with the air-tightness disc with relation to pulling and controlling of the air-tightness disc; a positioning member is riveted to the air-tightness disc at the center hole; and bottom cylinder ring is made from TEFLON material as one piece and is used to engage at the bottom recess of the piston head body to form into an auxiliary second cylinder ring.

DETAILED DESCRIPTION OF THE PREFERRED EMBODIMENT

Figure 1:
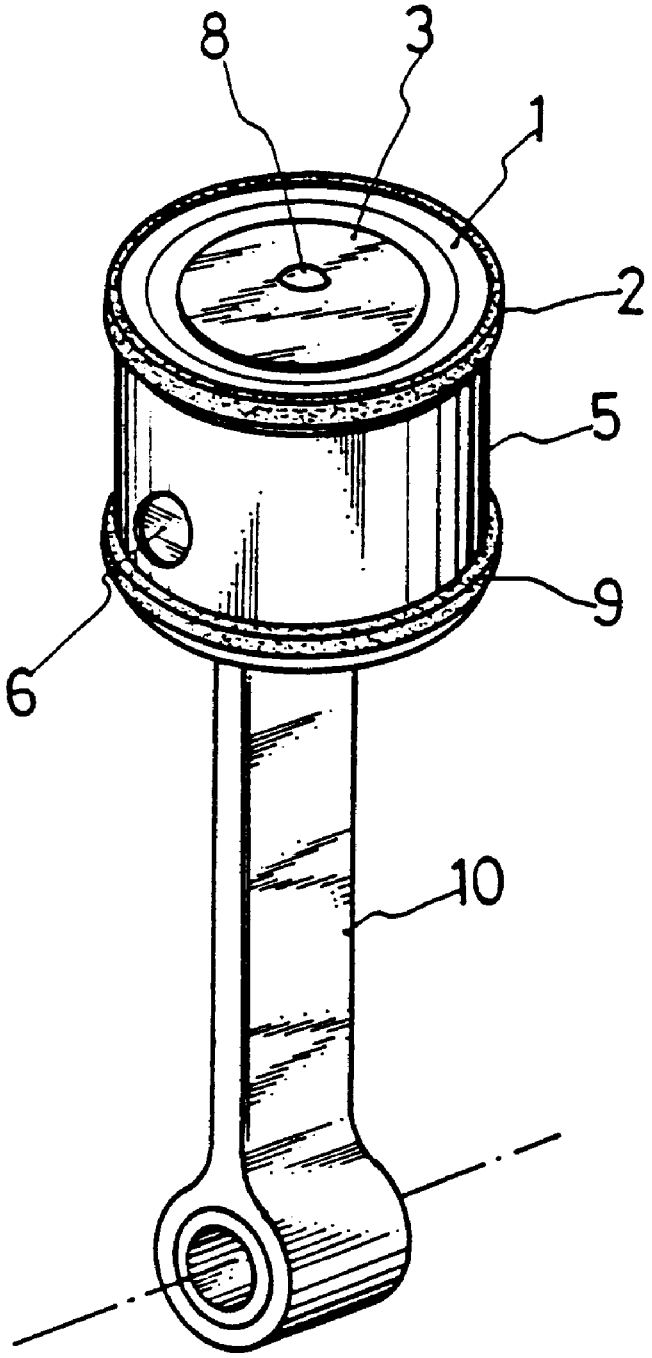
FIG. 1 is a perspective view of the piston in accordance with the present invention.
Figure 2:
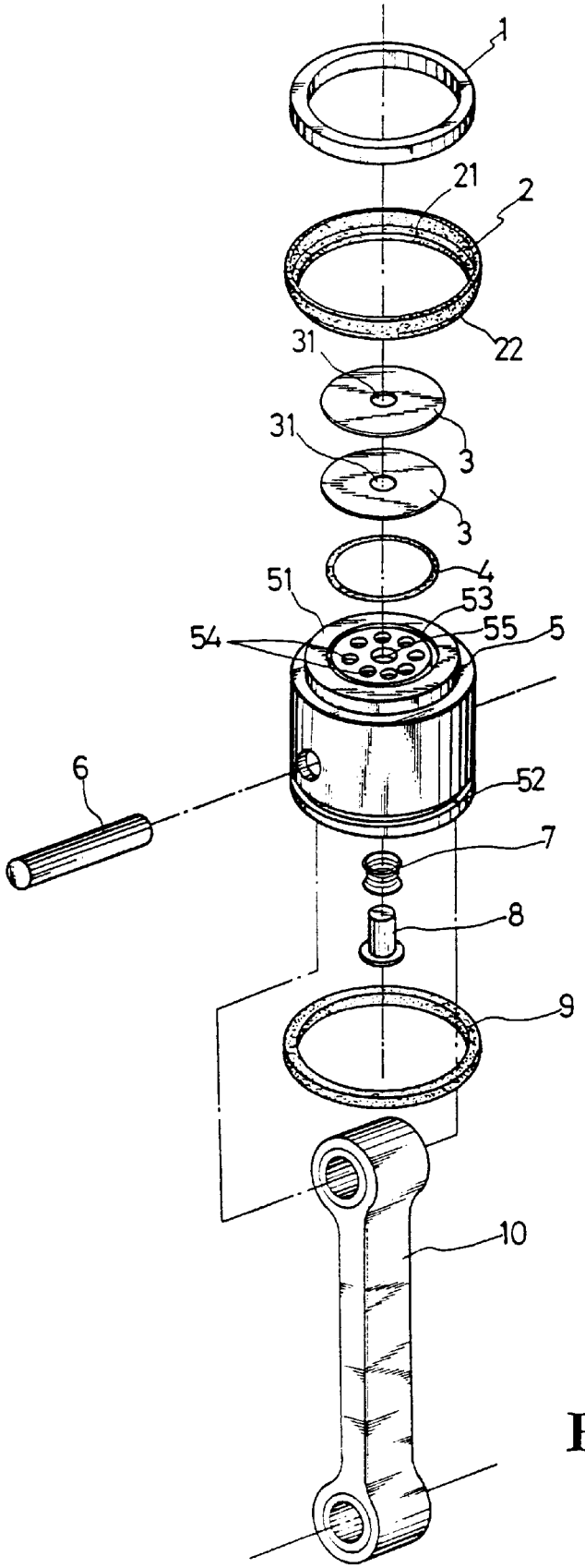
FIG. 2 is a perspective exploded view of the piston in accordance with the present invention.

Referring to FIGS. 1 and 2, there is shown a piston assembly comprising a pressure engaging ring 1, a top cylinder ring 2, an air-tightness disc 3, an air-tightness ring 4, a piston head body 5, a piston pin 6, a resilient member 7, a positioning member 8, a bottom cylinder ring 9, and a linking rod 10.

In accordance with the present invention, the top and the bottom cylinder rings 2, 9 are made from TEFLON material with wear-resistant and high temperature resistant properties. The top cylinder ring 2 has a bottom lip edge section 21 at the interior diameter thereof and is extended from the lower section of the exterior diameter thereof to form an inclined surface 22. When the top cylinder ring 2 is located at the external edge of an protruded section 51 located at the top of the piston head body 5, the pressure engaging ring 1 can firmly secure the top cylinder ring 2 onto the external edge of the top protruded section 51 of the piston head body 5 to form a first cylinder ring. In accordance with the present invention, the first cylinder ring can be dismantled for replacement and provides a high air tightness ability by having the pressure engaging ring 1 to cause the cylinder ring 2 to maintain an urging action at the circumference, and at the same time, to maintain a circular shape at the top cylinder ring 2. Thus, the air-tightness capability of the piston is improved.

In accordance with the present invention, the bottom cylinder ring 9 is located at a bottom recess 52 formed at the lower edge of the piston head body 5 to form into an auxiliary second cylinder ring.

As shown in FIG. 2, the piston head body 5 is provided with the top protruded section 51, and a recess 53 is formed at the top surface of the protruded section 51 for the mounting of the air tightness ring 4. The air tightness ring 4 is functioned to secure air-tightness at the circumferential edge of the air-tightness disc 3. Further, within the recess 53 of the protruded section 51, a plurality of air holes 54 and a center hole 55 are provided, and the air-tightness disc 3 is used to seal the hole.

At this instance, the positioning member 8 is mounted from the bottom section of the piston head body 5 so that the positioning member 8 is secured via the center hole 55. The positioning member 8 is riveted together with the air-tightness disc 3 at the center hole 55 thereof. The positioning member 8 makes use of the resilient member 7 to urge the air-tightness disc 3 to provide a pulling and controlling action so that the air-tightness disc 3 opens or closes as a result of a top and bottom instantaneous displacement caused by constant force formed by the resilient member 7 and the reciprocation action of the cylinder. In accordance with the present invention, the air-tightness disc 3 can be implemented with more than one disc 3.

Figure 3:
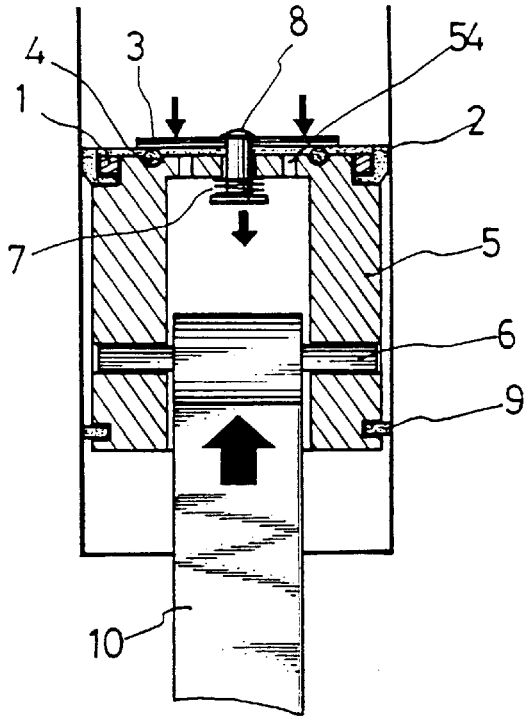
FIG. 3 is a sectional view of the piston, illustrating the upward motion of the piston, in accordance with the present invention.

Referring to FIG. 3, when the piston 5 reciprocates within the cylinder as a result of driving by a motor and the crankshaft (not shown) and moves upward to compress the air, due to the action of the air within the cylinder and the force produced by the resilient member 7, the air-tightness disc 3 remains at a closed position such that the compressed air can be expelled out to achieve the function of air filing.

Figure 4:
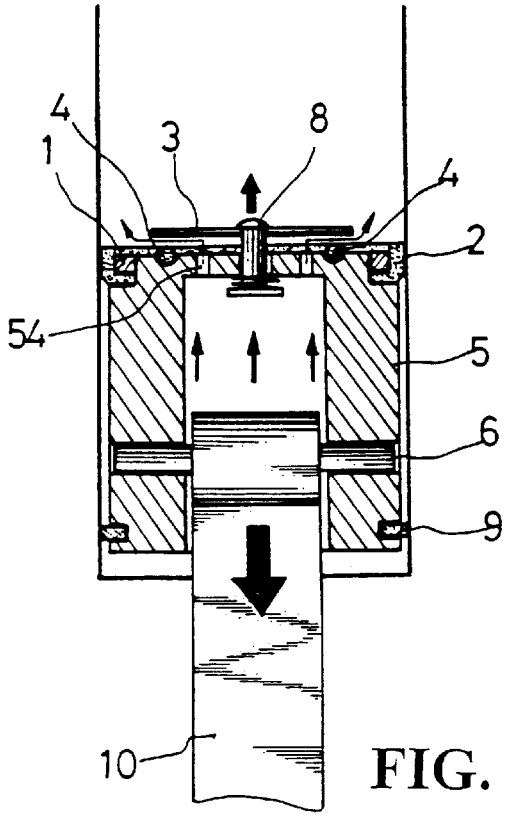
FIG. 4 is a sectional view of the piston, illustrating the downward motion of the piston, in accordance with the present invention.
Figure 5:
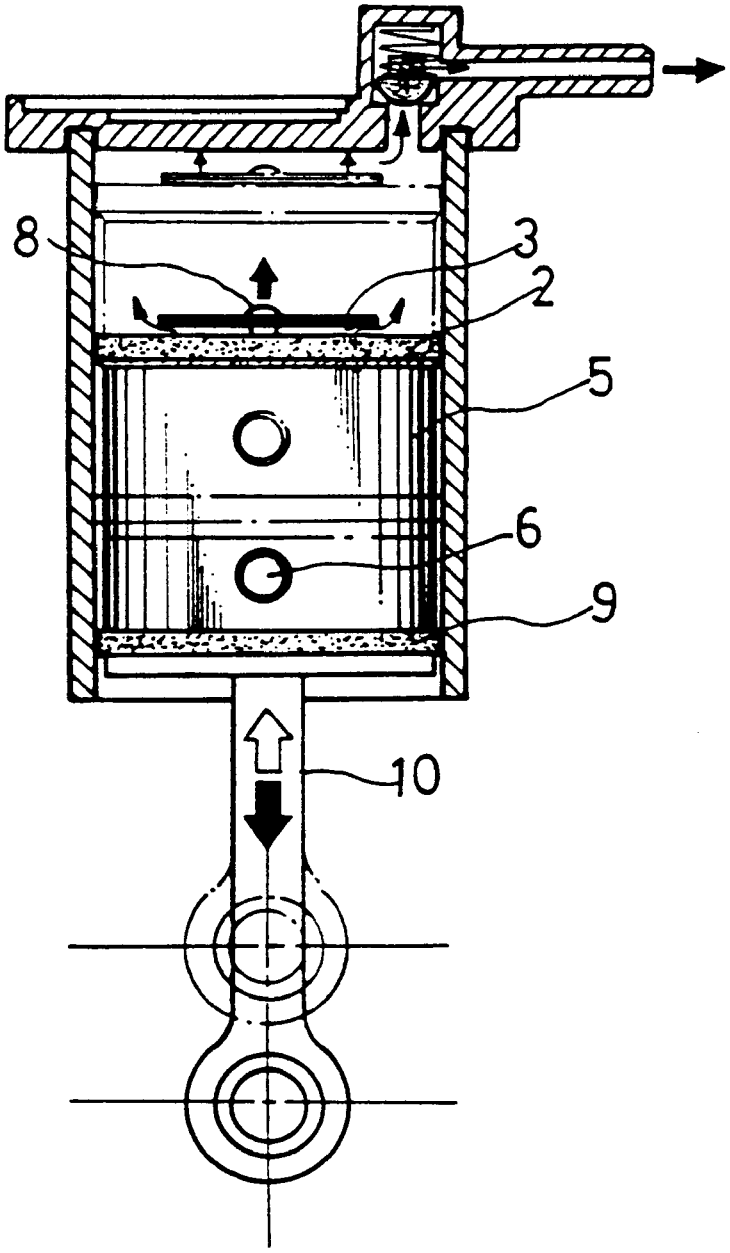
FIG. 5 is a sectional view of the piston assembly of a cylinder, illustrating the reciprocating motion of the piston, in accordance with the present invention.
Figure 6:
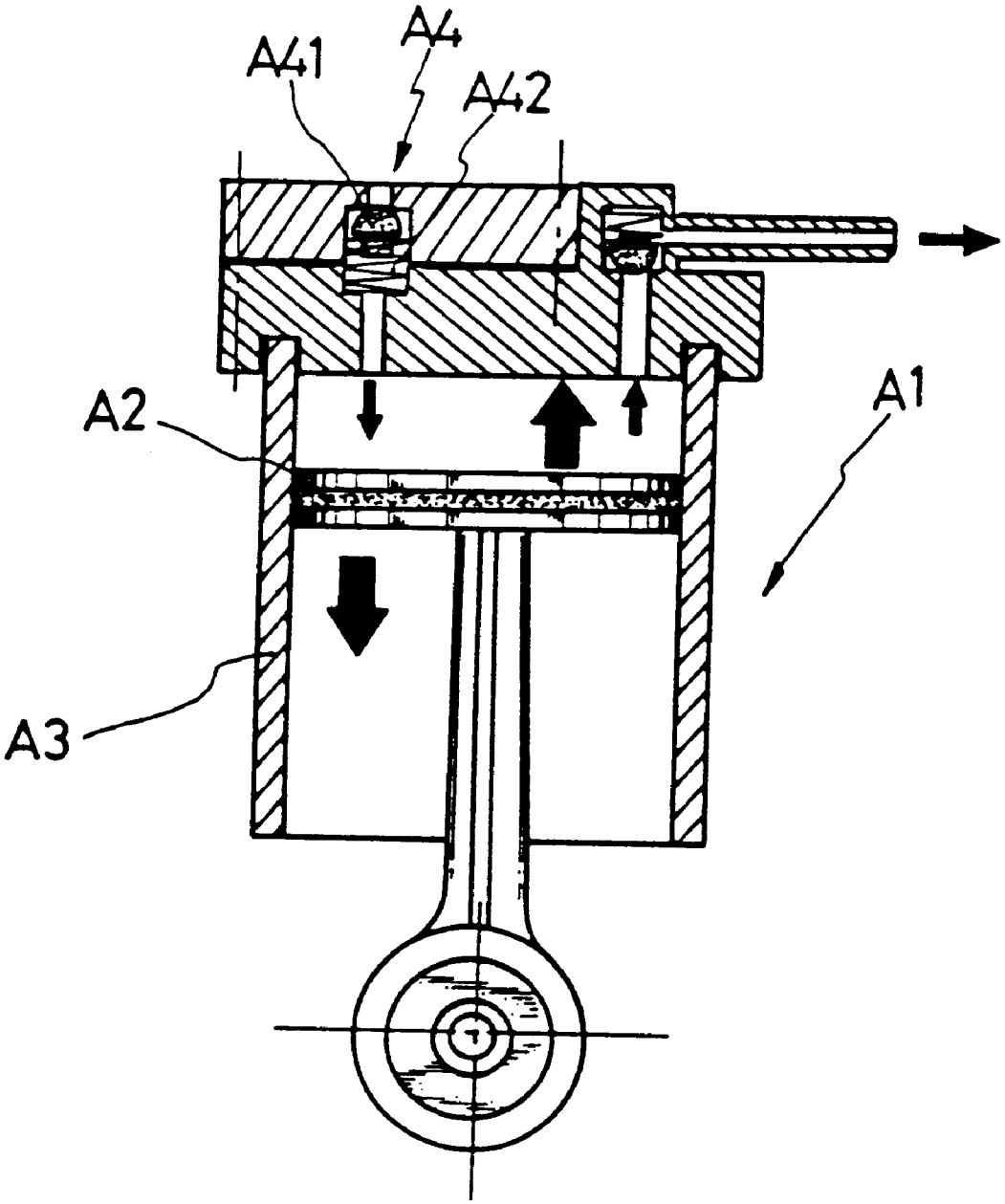
PRIOR ART FIG. 6
FIG. 6 is a sectional view of a conventional piston assembly of a conventional air-filing compressor.

Referring to FIG. 4, when the piston 5 moves downward with a great speed, the external air rapidly enters the air holes 54 at the bottom of the piston head body 5 so as to push away the air-tightness disc 3. Thus, the air-tightness disc 3 forms an instantaneous upward action and the air rapidly enters the cylinder, which is then compressed to expel by the piston. Based on the cycle of the reciprocation action, high frequency air inlet and air outlet procedures can be achieved simultaneously, which is shown in FIG. 5.

In accordance with the present invention, the advantages and characteristics of the piston structure are as follows 1) As the top and upper cylinder rings are made from TEFLON, after these rings have been worn out, they can be replaced.
2) The present structure provides a rapid opening and closing of the air-tightness disc in relation to the speed of the piston.
3) The structure of air-tightness disc is simple and does not easily damage. Thus, the longevity of the air tightness disc is improved.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiments, but only by the scope of the appended claim.

What is claimed is:

1. An improved structure of a piston of an air-filing device comprising a pressure engaging ring, a top cylinder ring, an air-tightness disc, an air-tightness ring, a piston head body, a piston pin, a resilient ring, a positioning member, a bottom cylinder ring, and a linking rod, characterized in that:

(a) the pressure engaging ring is used to secure the top cylinder ring onto an external edge of a protruded section located at the top of the piston head body;

(b) the top cylinder ring is made from TEFLON material and has a bottom lip edge section at the interior diameter thereof and is extended from a lower section of the exterior diameter thereof to form an inclined surface, (c) the air tightness disc has a flat circular shape and has a center hole, and is used to pull and control the positioning member, the air-tightness disc is located at a protruded surface at the top of the piston head body so as to press and seal the air tightness ring, and close and seal at an air hole located at the protruded surface of the piston head body;

(d) the air-tightness ring is made from a rubber material and is retained at a recess provided at a top protruded surface of the piston head body to assure air-tightness capability at the circumference of the bottom edge of the air-tightness ring;

(e) the piston head body is provided with a top protruded section, and a recess is formed at the top surface of the protruded section, a plurality of air holes and center hole are provided within the recess; a bottom recess is provided below the piston head body;

(f) a resilient member having elasticity is mounted to the positioning member which is functioned together with the air-tightness disc with relation to pulling and controlling of the air-tightness disc;

(g) a positioning member is riveted to the air-tightness disc at the center hole; and (h) bottom cylinder ring is made from TEFLON material as one piece and is used to engage at the bottom recess of the piston head body to form into an auxiliary second cylinder ring.

* * * * *